United States Patent [19]

Ohira et al.

[11] Patent Number: 4,837,599

[45] Date of Patent: Jun. 6, 1989

[54] COPYING APPARATUS HAVING AN EDITING FUNCTION

[75] Inventors: Tadashi Ohira, Toyokawa; Masazumi Ito, Toyohashi; Syuzi Maruta, Toyokawa, all of Japan

[73] Assignee: Minolta Camera Kabushiki Kaisha, Osaka, Japan

[21] Appl. No.: 71,710

[22] Filed: Jul. 1, 1987

[30] Foreign Application Priority Data

Jul. 5, 1986 [JP] Japan ..... 61-158186

[51] Int. Cl.[4] ..... G03G 15/052

[52] U.S. Cl. ..... 355/7; 355/69

[58] Field of Search ..... 355/1, 3 R, 7, 14 E, 355/69

[56] References Cited

U.S. PATENT DOCUMENTS

| | | | |
|---|---|---|---|
| 4,215,929 | 8/1980 | Sato et al. | 355/7 |
| 4,256,400 | 3/1981 | Komori et al. | 355/7 X |
| 4,543,643 | 9/1985 | Shibazaki et al. | 364/900 |
| 4,582,417 | 4/1986 | Yagasaki et al. | 355/7 |
| 4,653,899 | 3/1987 | Watanabe | 355/7 X |
| 4,695,154 | 9/1987 | Watanabe | 355/8 |
| 4,728,982 | 3/1988 | Takemura | 355/3 R |
| 4,734,734 | 3/1988 | Yano | 355/3 R |

FOREIGN PATENT DOCUMENTS 2011647 7/1979 United Kingdom .

*Primary Examiner*—Fred L. Braun

*Attorney, Agent, or Firm*—Price, Gess & Ubell

[57] ABSTRACT

A copying apparatus, having an editing function, charges a rotating photoconductive drum 61 by chargers 63 and 65 and forms an electrostatic latent image on the photoconductive drum 61 by projecting an image of a document on the drum 61, whereby the electrostatic latent image is developed by toner. An erasure array 4 including LED elements is provided close to the photoconductive drum 61. In an edit copy mode, data for specifying a region to be copied on the document is inputted by using keys on an operation panel. As a result, the erasure array 4 removes the electric charge on a region of the photoconductive drum 61 corresponding to the specified region prior to exposure, whereby the electrostatic latent image can be prevented from being formed on this region. At this time, a control apparatus controls the extent of emission of light of the erasure array 4 and the timing for the emission of light of the erasure array 4 based on the input data, thereby to prevent occurrence of deviation in boundary portions of the region defined in the edit copy mode.

6 Claims, 10 Drawing Sheets

COPYING APPARATUS HAVING AN EDITING FUNCTION

BACKGROUND OF THE INVENTION

1. Field of the Invention

The present invention relates to a copying apparatus and particularly to a copying apparatus having a so-called editing function, namely, a function of forming an image of only a specified region of a document on a sheet of copy paper.

2. Description of the Prior Art

Among conventional image forming devices used in copying apparatuses or the like, which generally form an electrostatic latent image on a photoconductor by applying exposure and scanning processes to a document and develop the image by using toner, thereby to transfer it onto a sheet of copy paper, there have been proposed or provided image forming devices having a so-called editing function, namely, the function of forming an image of only a specified region of a document on copy paper.

In principle, such an editing function is performed to remove, by exposure, an electric charge on a region of a photoconductor corresponding to an undesired region of a document prior to development of the electrostatic latent image, causing it to be impossible to apply development by toner to the above stated region, whereby formation of an image of the undesired region can be prevented.

The removal of an electric charge on the above stated region is generally performed by an erasure array having a large number of light emitting elements.

Copying apparatuses having such editing function are disclosed, for example, in the following documents.

The U.S. Pat. No. 4,582,417 discloses an apparatus for forming images in which an unnecessary portion of an image of a document is erased by controlling the turning on and off of a blank lamp; U.S. Pat. No. 4,256,400 discloses a copying machine in which an unnecessary portion of an image of a document is erased by partially intercepting through use of a masking member, the light applied from a lamp to a photosensitive medium to erase a latent image; U.S. Pat. No. 4,215,929 discloses an image forming method and apparatus in which an unnecessary portion of an image of a document is erased by partially intercepting, by a masking member or polarizing plates, the light applied from a lamp to a photosensitive body to erase a latent image; and the U.S. Pat. No. 4,653,899 discloses an image forming apparatus in which an unnecessary portion of an image of a document is erased by controlling the turning on and off of an erasure array. In addition, the U.S. Pat. No. 4,543,643 discloses fundamental operation and control of a copying apparatus.

The above stated conventional copying apparatuses have, however, a disadvantage that image formation in end portions of the edited region is effected inaccurately.

For example, as shown in FIG. 1, if an image forming operation is performed to cause a region surrounded by the lines A, B, C and D (a region surrounded by the solid lines) to be a blank portion (in an erase mode), the image is formed in reality with a region surrounded by the lines A', B', C' and D' (a hatched region surrounded by the broken lines) being a blank portion.

Conversely, as shown in FIG. 2, if image forming operation is performed to cause the portion outside the region surrounded by the lines A, B, C and D (the portion outside the region surrounded by the solid lines) to be a blank portion (in a trimming mode), the image is formed in reality with a portion outside a region surrounded by the lines A'', B'', C'' and D'' (namely, the hatched portion outside the region surrounded by the broken lines) being a blank portion.

In addition, as shown in FIG. 3, if image forming operation is performed to combine the images formed by the operations shown in FIGS. 1 and 2, the hatched portion remains as a blank portion, and thus, a white frame is formed in boundary portions of the two images.

Such problem is caused by the fact that light from the light emitting elements of an erasure array has a certain peripheral extent.

More specifically, as shown in FIG. 1, if a blank portion is to be formed in the region surrounded by the lines A, B, C and D, light emitting elements located between the lines C and D are selected as the light emitting elements to be illuminated and control operation is performed so that the time of start of illumination of the selected light emitting elements and the time of end thereof coincide with the time corresponding to A and the time corresponding to B, respectively. A reference point for selection of the above stated light emitting elements and the time of start and the time of end of illumination (reference point for coincidence with the solid lines A, B, C and D) is located at the center of the light emitting surface or the irradiated light of the light emitting elements.

As a result, as shown for example in FIG. 4, a sum of an extending amount l1 from the center E of the light emitting surface L and a diffusing amount l2 of light is unavoidably generated as a "deviation amount" from the reference point at the center, and the light having the deviation amount is applied to the photoconductor, resulting in a deviation as shown by the portion defined by the outer lines A', B', C', D', and the inner lines A'', B'', C'' D''.

SUMMARY OF THE INVENTION

Therefore, a primary object of the present invention is to provide a copying apparatus capable of preventing the occurrence of such a deviation as described above in boundary portions of an edited region, without changing a construction of a conventional erasure array.

Briefly stated, the present invention is a copying apparatus capable of copying a desired region of a document and the copying apparatus comprises: a rotating photoconductor; means for charging the photoconductor in advance; means for projecting an image of the document on the charged photoconductor to form an electrostatic latent image on the photoconductor; means for developing the formed electrostatic latent image; light emitting means having a predetermined width of emission of light for exposing to light the photoconductor where the electrostatic latent image is formed, prior to development of the electrostatic image at the latest, thereby to erase an unnecessary portion corresponding to a region other than the desired region of the document out of the electrostatic latent image; means for inputting data for specifying the desired region of the document to be copied; and control means for controlling the time of emission of light of the light emitting means based on data concerning the width of emission of light of the light emitting means and the inputted data for specifying the desired region.

According to another aspect of the present invention, the light emitting means has an array comprising a plurality of light emitting elements and the control means includes means for selecting light emitting elements to be illuminated out of the plurality of light emitting elements of the light emitting means based on the inputted data for specifying the desired region.

Accordingly, a principle advantage of the present invention is that the light emitting means is controlled based on the data for specifying the desired region and the data of the width of emission of light of the light emitting means thereby to adjust the time of emission of light taking into account the deviation in the boundary portions.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
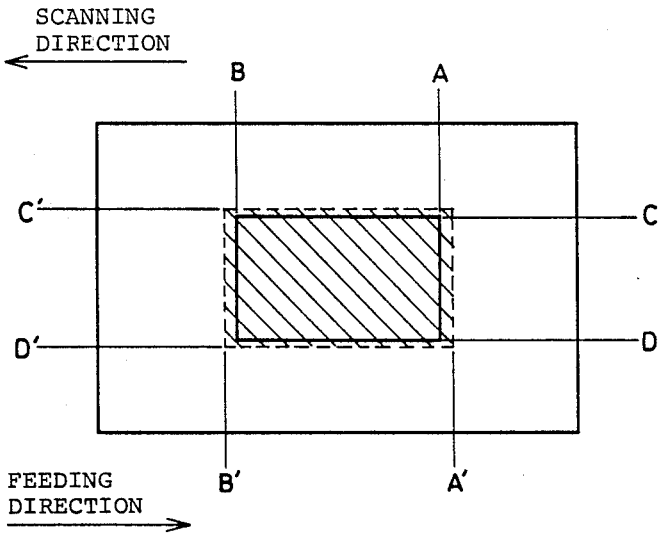
FIG.1 PRIOR ART
FIG. 1 is an illustration for explaining conventional image formation by edition in an erase mode.
Figure 2:
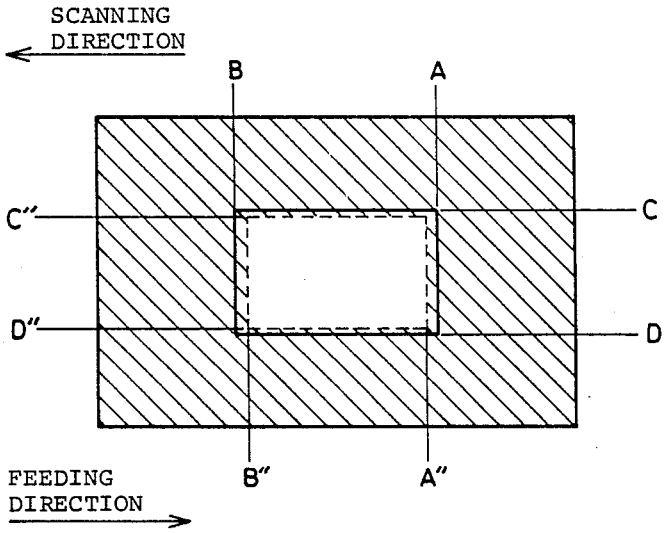
FIG.2 PRIOR ART
FIG. 2 is an illustration for explaining conventional image formation by edition in a trimming mode.
Figure 3:
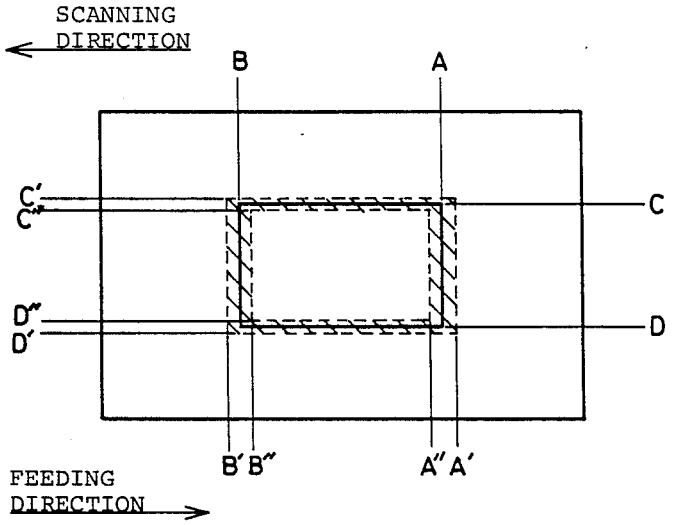
FIG. 3 PRIOR ART
FIG. 3 is an illustration for explaining conventional image formation by edition in a composite copy mode.
Figure 4:
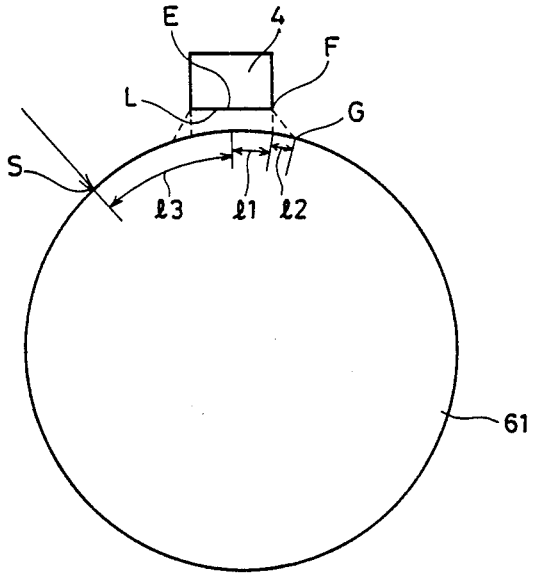
FIG. 4 PRIOR ART
FIG. 4 is an illustration for explaining a deviation amount of irradiated light of light emitting diode elements.

The present invention will be described in the following, with reference to a concrete embodiment shown in the drawings.

(I) Description of a Main Body of a Copying Apparatus

Figure 5:
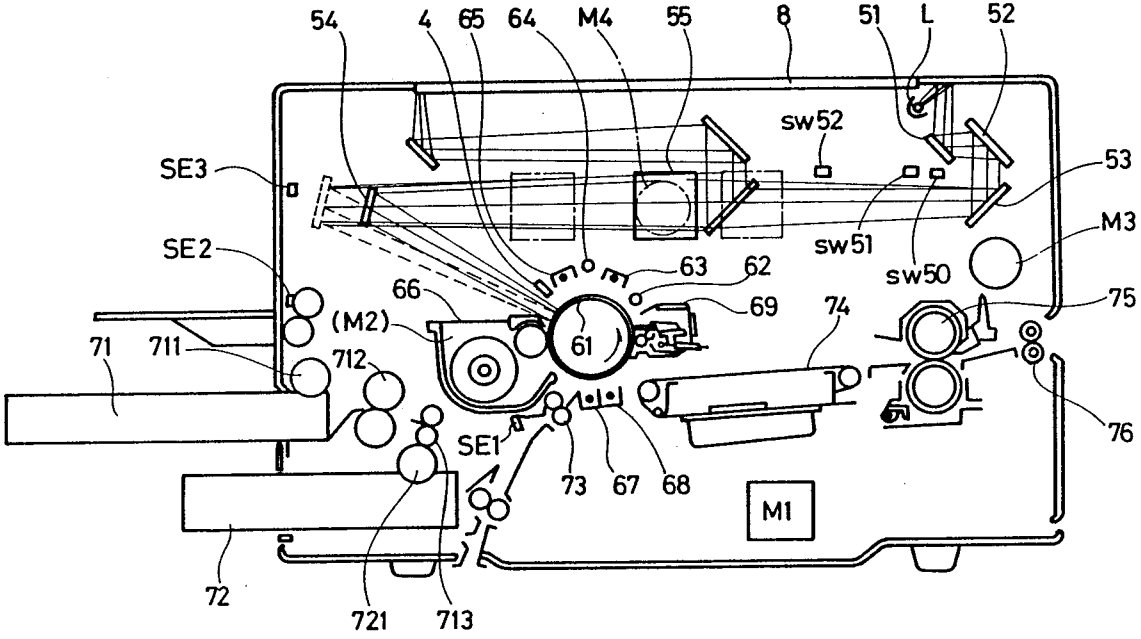
FIG. 5 is a typical view showing a construction of a copying apparatus of an embodiment of the present invention.

FIG. 5 is a typical view showing a construction of a main body of a copying apparatus of the embodiment.

Referring first to FIG. 5, a mechanical construction and fundamental copying operation of the main body of the copying apparatus will be described.

As shown, the copying apparatus of this embodiment comprises: an optical system including components 51 to 55 for scanning a document by exposure to transmit an image; a copying portion including components 61 to 69 for forming the transmitted image on a sheet of copy paper by an electrophotographic process; a paper feeding and discharging system including components 71 to 76 for feeding sheets of copy paper and fixing the image; and a document table 8 of glass.

(a) Optical System

The optical system is controlled by a second microprocessor to be described afterwards. The optical system comprises a light source (lamp) L, mirrors 51, 52, 53 and 54, a lens 55, and a drive mechanism not shown. This optical system moves forward and backward repeatedly along a lower surface of the document table 8 so that a surface of a document can be scanned for exposure when the optical system moves in a forward direction. More specifically, light reflected from the document is reflected on the mirrors 51, 52 and 53 and then it passes through the lens (a lens block for variable magnification) 55. Further, the light is reflected on the mirror 54 to attain a photoconductive drum 61, whereby an image is formed on a surface of the drum 61. The mirrors 51, 52 and 53 are driven by a motor M3 for exposure scanning so as to be moved together. Assuming that a rotating speed of the photoconductive drum 61 is V, a moving speed of the mirror 51 is V/M (M being a copying magnification) and a moving speed of the mirrors 52 and 53 is V/2M so as to maintain a constant length of a light path. On the other hand, the mirror 54 and the lens 55 are driven together by a motor M4 for setting magnification. The lens 55 moves on an optical axis to change the copying magnification and the mirror 54 moves and oscillates to correct an imaging point.

(b) Copying Portion

The copying portion is controlled by a first microprocessor to be described afterwards. The copying portion comprises: a photoconductive drum 61 rotatable in a direction indicated by the arrow; a main eraser lamp 62 provided near the drum 61; an auxiliary charger 63; an auxiliary eraser lamp 64; a main charger 65; a developing device 66; a transfer charger 67; a copy paper separation charger 68; and a cleaning device 69 of a blade type. An erasure array 64 to be described afterwards is provided between the main charger 65 and the developing device 66, close to the photoconductive drum 61.

A photoconductive layer is formed on a surface of the drum 61 and the photoconductive layer is charged increasingly when it passes along the eraser lamps 62 and 64, and the chargers 63 and 65, and it is exposed to light from the optical system in a slit manner so that an electrostatic latent image is formed thereon. The electrostatic latent image is not formed on a region where electric charge has been removed by the erasure array 4 prior to the exposure.

Toner is adhered to the thus formed electrostatic latent image by means of the developing device 66 and the adhered toner is transferred by means of the transfer charger 67 onto a sheet of copy paper (fed through a timing roller 73 of the paper feeding and discharging system).

(c) Paper Feeding and Discharging System

The paper feeding and discharging system is controlled by the first microprocessor to be described afterwards. The paper feeding and discharging system comprises: an upper cassette 71 and a lower cassette 72;

delivery rollers 711 and 721 of the respective cassettes; transport rollers 712 and 713; timing rollers 73; a transport belt 74; a fixing device 75; discharge rollers 76 and the like. Those components are driven by the main motor M1.

(II) Description of an Operation Panel

Figure 6:
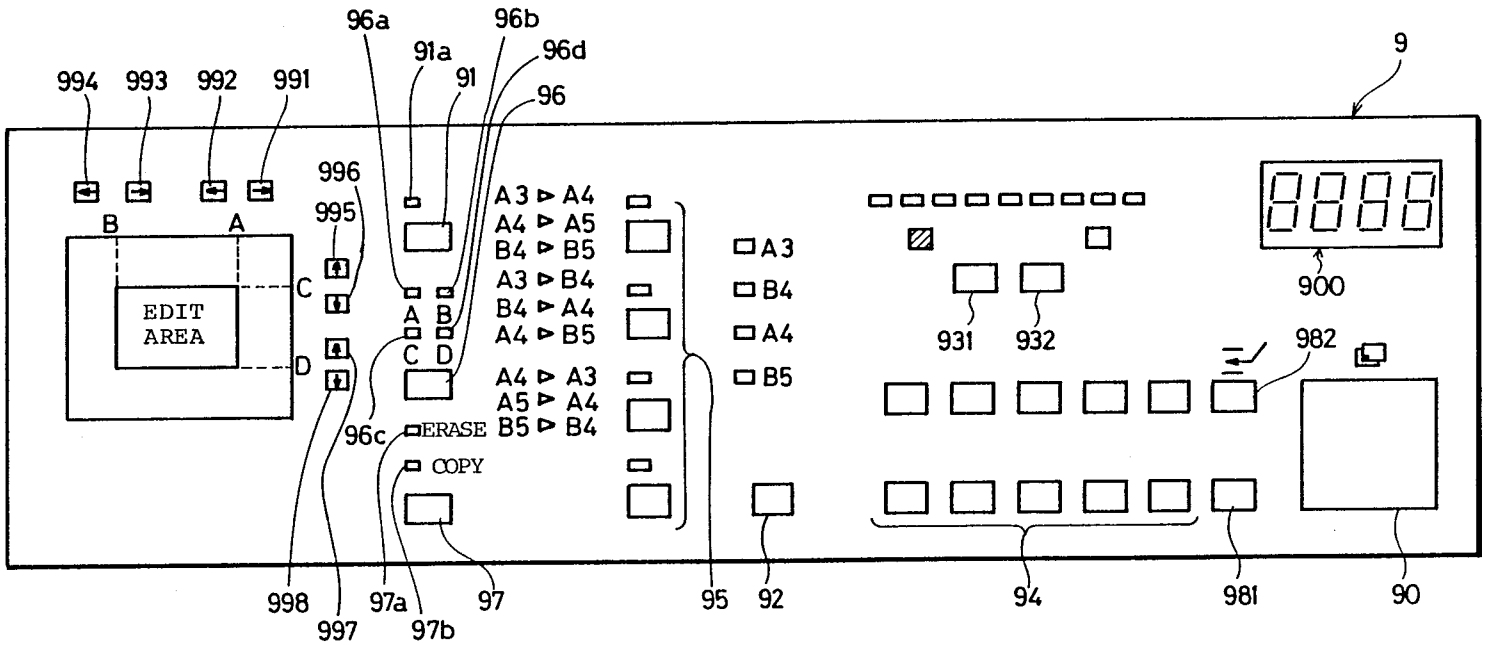
FIG. 6 is a plan view showing an operation panel of the copying apparatus shown in FIG. 5.

FIG. 6 is a plan view showing the operation panel of the copying apparatus shown in FIG. 5. Referring now to FIG. 6, keys and displays of the operation panel will be described.

As shown, the panel 9 comprises: a print key 90 for starting copy operation; a copy mode selection key 91 for selecting a normal copy mode or an edit copy mode; a copy paper selection key 92 for selecting copy paper of a desired size stored in the cassette 71 or 72; an up-key 932 and a down-key 931 for changing copy density; a ten-key group 94 (corresponding to numerical values 1, 2, . . . 9 and 0) for inputting the number of sheets of copy paper or numeric edit coordinate data; a magnification setting key group 95 for calling a preset copying magnification; a coordinate display key 96 for displaying edit coordinate data; an erase mode selection key 97 for selecting an erase mode (for erasure of a specified area) or a trimming mode (for erasure outside a specified area); a clear stop key 981; an interruption key 982; fine adjustment keys 991 to 998 for fine adjustment of coordinate data; and a display 900 for displaying in a segment form the number of sheets of copy paper or edit coordinate data.

In FIG. 6, small rectangular or triangular elements are LED lamps for indicating that the keys or marks associated therewith are in a selected state.

(III) Description of the Erasure Array

Figure 7:
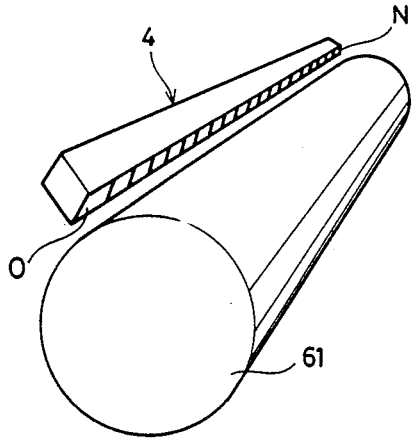
FIG. 7 is a perspective view showing a positional relation between an erasure array and a photoconductive drum.
Figure 8:
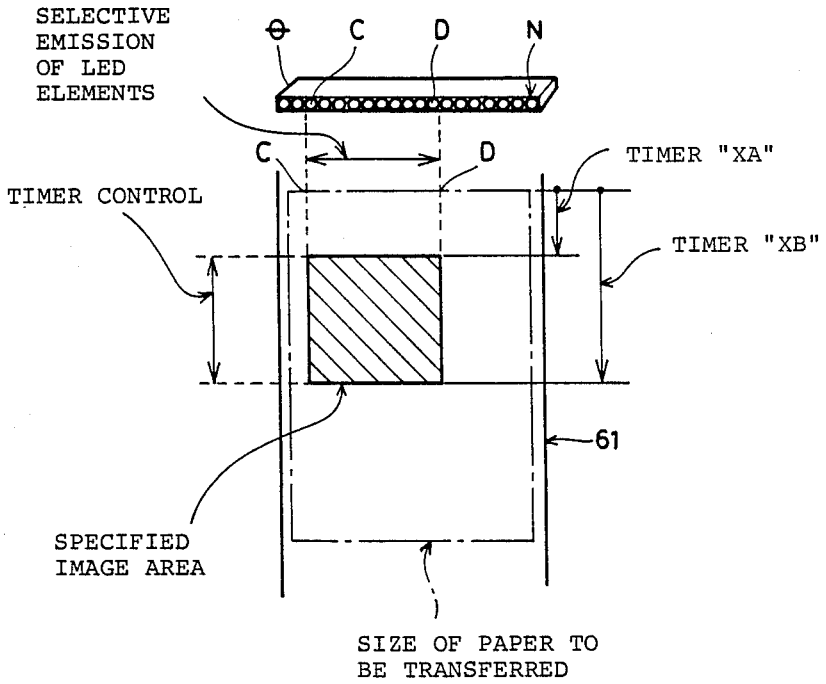
FIG. 8 is an illustration for explaining a relation between an erasure array and an erasing region.

FIG. 7 is a perspective view showing the erasure array 4 provided close to the photoconductive drum 61 and FIG. 8 is an illustration for explaining operation for removing electric charge of a specified area by the erasure array 4.

As shown, the erasure array 4 is an LED array having a large number of (N+1) LED elements in a row. By causing any LED elements selectively to emit light, the erasure array 4 removes the electric charge on a corresponding region of the photoconductive drum 61 so that the electrostatic latent image can be prevented from being formed on that region.

For example, as shown in FIG. 8, it is assumed that reference characters 0 to N are assigned to the (N+1) LED elements from the left in the drawing and that the LED elements from C to D are turned on in a period from the time of the end of a timer XA to the time of the end of a timer XB. Then the electric charge on an area of the drum 61 corresponding to the hatched portion in the drawing is removed and the electrostatic latent image is not formed on that area. Accordingly, an image to be copied is not transferred on that area.

(IV) Description of the Control Portion

Figure 9:
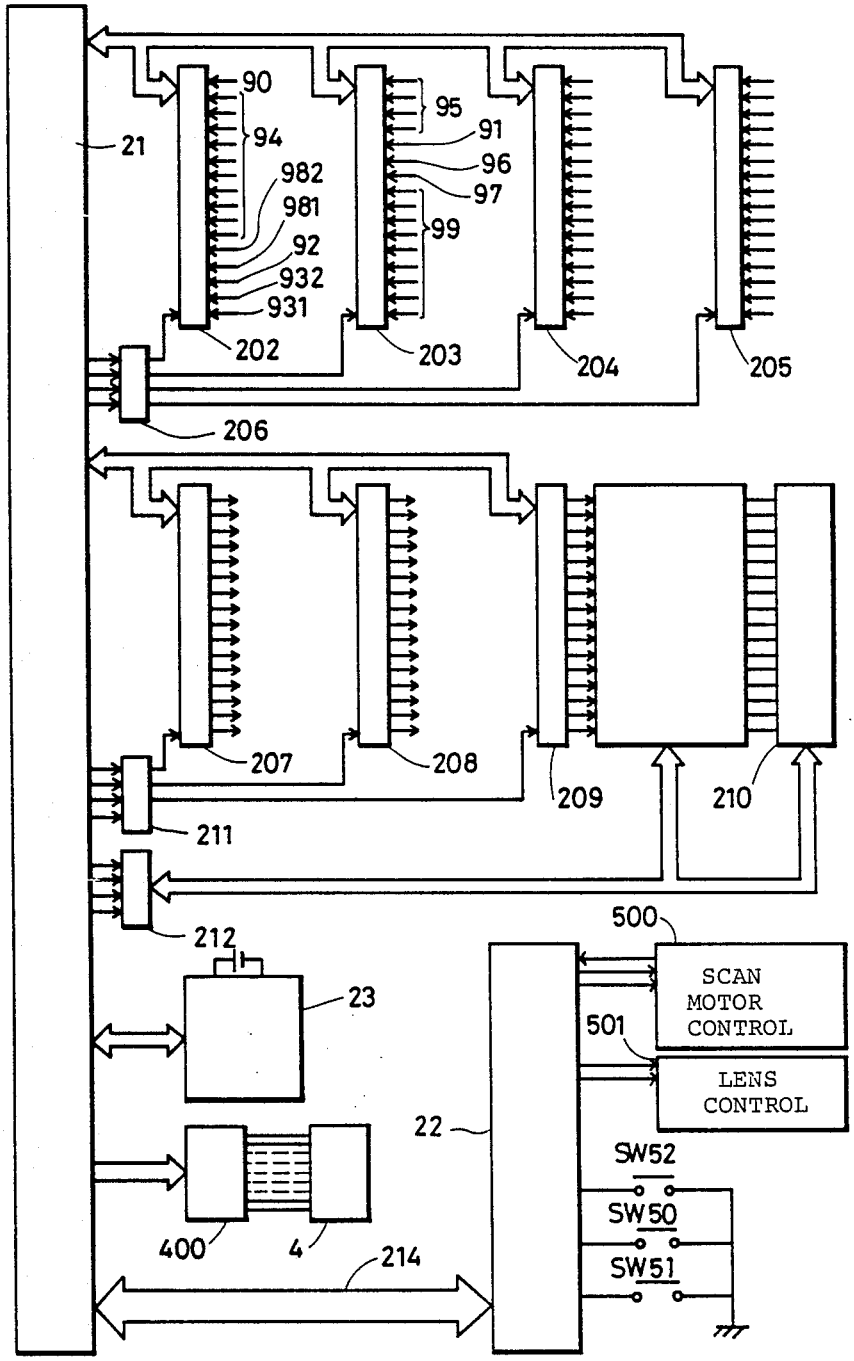
FIG. 9 is a diagram showing a construction of a control portion of the copying apparatus of the embodiment of the present invention.

FIG. 9 is a diagram showing a construction of the control portion of the copying apparatus shown in FIG. 5.

As shown in FIG. 9, the control portion comprises the first microprocessor 21, the second microprocessor 22 and a RAM 23, and a driver 400 of the erasure array 4 is connected to the first microprocessor 21.

The first microprocessor 21 is connected to input extension IC's 202 to 205 selected through a chip selecting decoder 206 and is further connected through the input extension IC's 202 to 205 to the keys 90 to 998 of the operation panel 9 and to a sensor group provided in the paper feeding and discharging system. Further, the first microprocessor 21 is connected to output extension IC's 207 to 209 selected through a chip selecting decoder 211 and is further connected through the output extension IC's 207 to 209 to the various drivers for the main motor M1, the developing motor M2, a clutch of the timing roller 73, a clutch of the delivery roller 711, a clutch of the delivery roller 721, the charger 65 and the transfer charger 67 or the like. In addition, the first microprocessor 21 is connected to a display LED device 210 on the operation panel 9 through the decoder 212.

The first microprocessor 21 is responsive to input through the above stated keys or sensors to control main operations of the copying apparatus, such as driving of the erasure array 4, the copying portion denoted by 61 to 69, and the paper feeding and discharging system denoted by 71 to 76, display of numeric data of the display area 900 and adjustment of temperature.

The second microprocessor 22 is connected to switches SW50 to SW52 provided in the components 51 to 55 of the optical system, a driver 500 of the exposure scanning motor M3 and a driver 501 of the magnification setting motor M4.

The second microprocessor 22 controls driving of the motors M3 and M4 in response to instruction from the first microprocessor 21 and generates predetermined signals, e.g. a timing signal in response to input through a sensor such as an image edge switch provided in the optical system.

The RAM23 is used to write various data such as coordinate data, data for correction of coordinates, data for control of copy operation and data for setting magnification (those data being supplied by input through the operation keys and the sensors for detecting operation states of the respective devices and also supplied from a ROM of the microprocessor) and is also used to read out those data.

(V) Description of the Operation

The operation of the copying apparatus of this embodiment will be described in the following.

Figure 10:
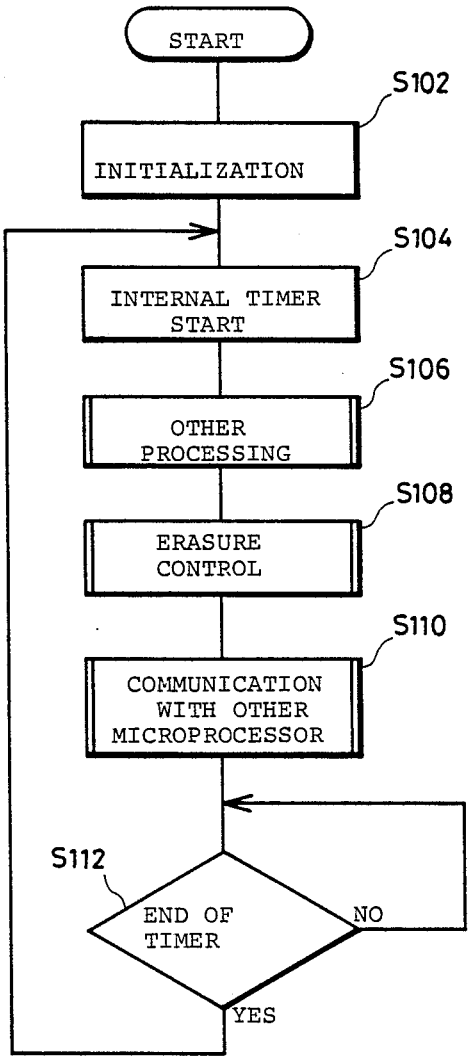
FIG. 10 is a flow chart showing a main routine of a first microprocessor 21 shown in FIG. 9.

FIG. 10 is a flow chart showing a main routine of the first microprocessor 21.

The first microprocessor 21 starts processing when the power supply is turned on. First of all, an initial state is set (in the step S102) and then a routine timer for determining a period of one routine is set (in the step S104).

Subsequently, procedures of subroutines in the steps S106 to S112 are executed.

The step S106 relates to all processing other than edit processing by the erasure array 4, such as copy operation, input through the keys, input through the sensors, output processing or adjustment of temperature. Details of the step S106 are disclosed, for example, in the above mentioned U.S. Pat. No. 4,543,643 and therefore description thereof is omitted hereinafter.

The step S108 is a step for removing electric charge on a specified area by controlling the erasure array 4, which will be described in detail with reference to FIGS. 11 to 13.

The step S110 relates to processing for communication with other microprocessors (such as the second microprocessor), which is performed by interruption processing.

After the above described processing operations are completed, the first microprocessor 21 waits for the end of the routine timer set in the step S104 and then returns to the step S104 (in the step S112).

Figure 11A:
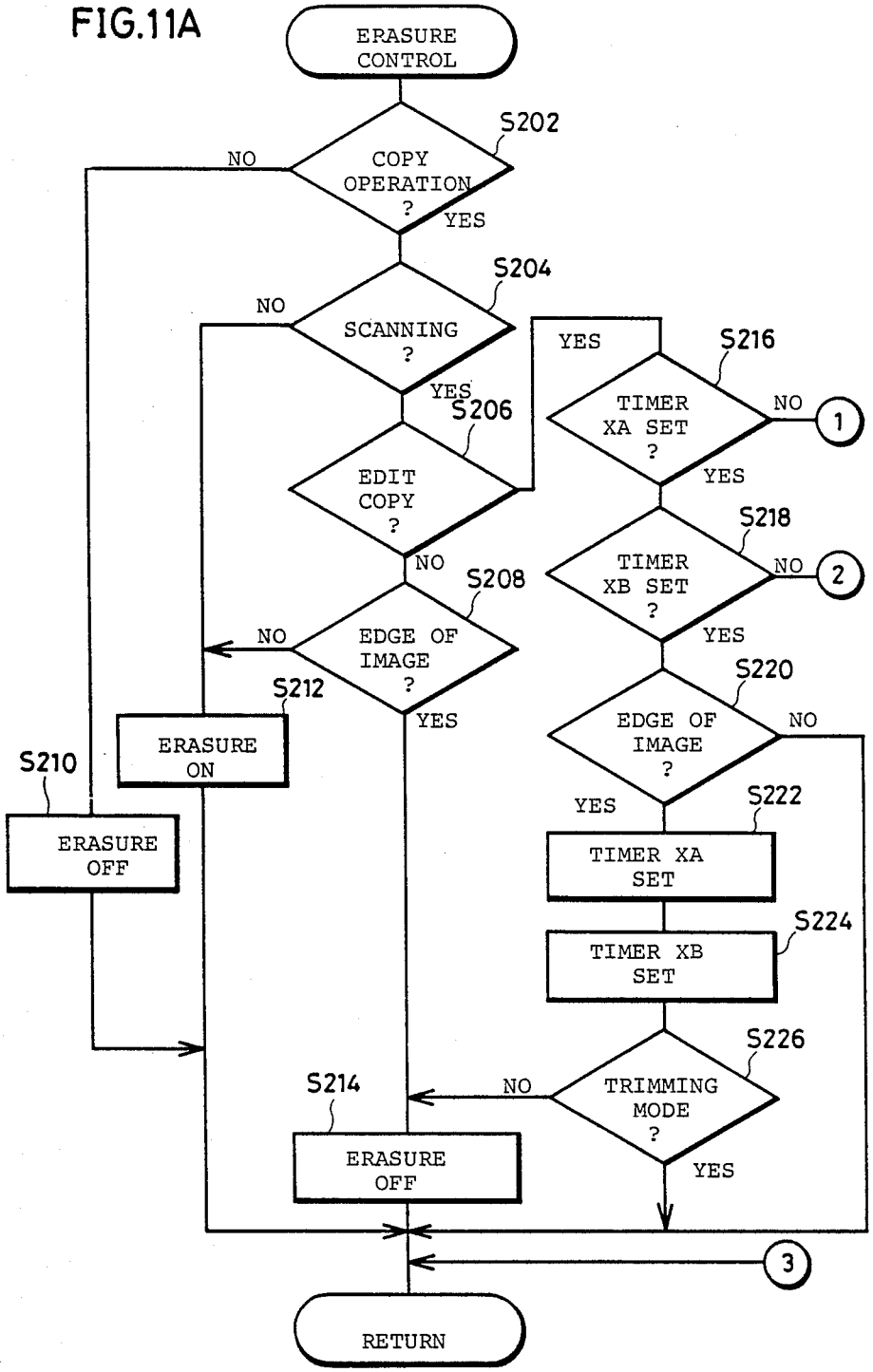
FIGS. 11A and 11B are flow charts showing details of the step S108 in FIG. 10.
Figure 11B:
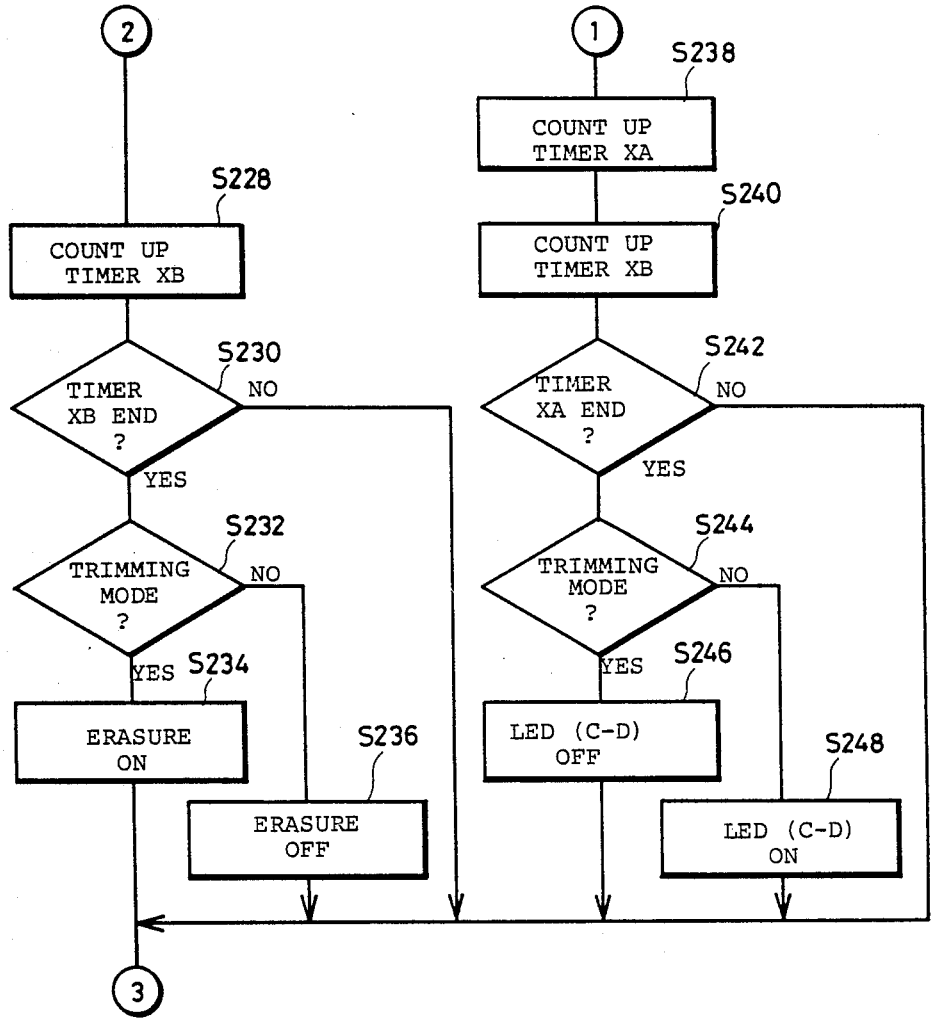

Figs 11A and 11B are flow charts showing details of the step S108 shown in FIG. 10. First, it is determined in the step S202 whether copy operation is being performed or not. If it is not being performed, the erasure array 4 is turned off (in the step S210). If a copy operation is being performed, the first microprocessor 21 proceeds to the step S204 to determine whether scanning is being performed or not. If scanning is not being performed, for example, in a period of return or in a period before scanning is started, the erasure array 4 is turned on for erasure of a specified region (in the step S212). On the other hand, if scanning is being performed, the first microprocessor 21 proceeds to the step S206 to determine whether the edit copy mode is selected or not. If the edit copy mode is not selected, a leading edge of an image is detected (in the step S208) and if the leading edge of the image is scanned, the erasure array 4 is turned off (in the step S214). If the edit copy mode is determined to be selected (in the step S206), the first microprocessor 21 advances to the step S216.

Then, it is determined (in the steps S216 and S218) whether the timer XA and the timer XB are set or not, respectively. If neither of the timers is set, the leading edge of the image is detected (in the step S220) and the timers XA and XB are set (in the steps S222 and S224). Subsequently, it is determined (in the step S226) whether the erase mode (for erasure of a specified area) or the trimming mode (for erasure outside the specified area) is selected. If the trimming mode is selected, the present state is maintained. If the erase mode is selected, the program proceeds to the step S214 to turn off all the LED elements of the erasure array 4. After that, the program returns to the main routine.

Then, if it is determined in the step S216 that the timer XA is set, the timers XA and XB perform upward counting (in the steps S238 and S240), and it is determined (in the step S242) whether the timer XA comes to an end. If the timer XA does not come to the end, the first microprocessor 21 completes the processing. If the timer XA comes to the end, it is determined (in the step S244) whether the trimming mode or the erase mode is selected. If the trimming mode is selected, the LED elements as shown from C to D in FIG. 8 are turned off (in the step S246). If the erase mode is selected, the LED elements as shown from C to D are turned on (in the step S248).

If the timer XB is set although the timer XA comes to the end (in the steps S216 and S218), the timer XB performs upward counting (in the step S228) and it is determined (in the step S230) whether the timer XB comes to an end. If the timer XB does not come to the end, the first microprocessor 21 completes the processing and when the timer XB comes to the end, the first microprocessor 21 determines whether the trimming mode or the erase mode is selected (in the step S232). If the trimming mode is selected, all the IED elements including the LED elements from C to D in FIG. 8 are turned on (in the step S234). If the erase mode is selected, all the LED elements including the LED elements from C to D are turned off and the program returns to the main routine.

Figure 12:
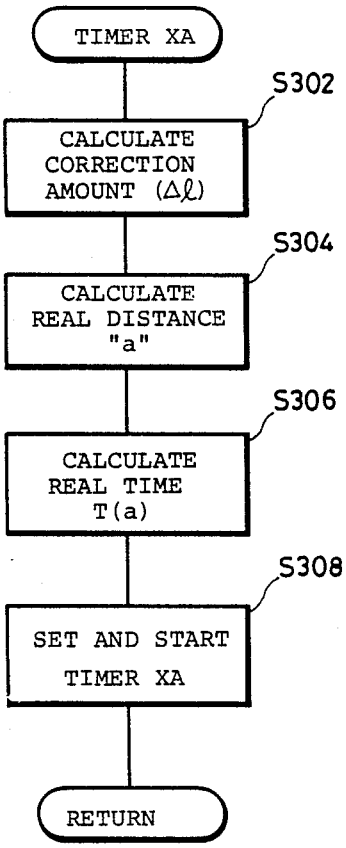
FIG. 12 is a flow chart showing details of the step S222 in FIG. 11A.

FIG. 12 is a flow chart showing details of the above described step S222 (for setting of the timer XA). First, a correction amount Δl is calculated by the following equation (in the step S302):

$$\Delta l = l1 + l2$$

where l1 is a distance between the center E of the light emitting surface and an edge F of the light emitting surface and l2 is a distance between the edge F of the light emitting surface and the outermost edge G of diffusion of light.

Then, a real distance a to be controlled is calculated as follows (in the step S304):

$$a = la - \Delta l - l3 \text{ (in the trimming mode)}$$

$$a = la + \Delta l - l3 \text{ (in the erase mode)}$$

where la is a distance from the center E of the light emitting surface to A and l3 is a distance from the center E of the light emitting surface to an exposure point S of an image.

Subsequently, real time T(a) to be controlled is calculated as follows (in the step S306).

$$T(a) = a/v \text{ (where v is a scanning speed)}$$

Then, the timer XA is set to the above indicated time T(a), so that it starts counting (in the step S308).

Figure 13:
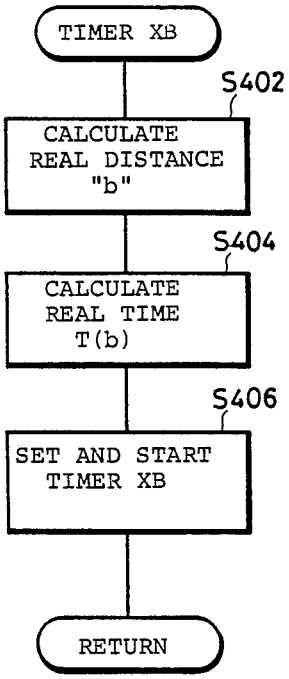
FIG. 13 is a flow chart showing details of the step S224 in FIG. 11A.

FIG. 13 is a flow chart showing details of the processing of the step S224 (for setting of the timer XB).

First, a real distance b to be controlled is calculated as follows (in the step S402).

$$b = lb - 66 - l3 \text{ (in the erase mode)}$$

$$b = lb + \Delta l - l3 \text{ (in the trimming mode)}$$

where b is a distance from the center E of the light emitting surface to B. The value obtained in the above described step S302 is used as Δl.

Then, real time T(b) to be controlled is calculated as follows (in the step S404).

$$T(b) = b/v \text{ (where v is a scanning speed)}$$

Then, the timer XB is set to the above indicated time T(b), so that it starts counting (in the step S406).

Thus, the copying apparatus of the present embodiment performs operation.

Variants of the Embodiment

Although occurrence of "deviation" in a paper feeding direction is prevented in the above described embodiment, it has no means for preventing occurrence of "deviation" in a direction perpendicular to the feeding direction.

However, if a similar method for selecting either of two adjacent LED elements located in a boundary portion is adopted to select suitable elements for decreasing the deviation, it becomes possible to reduce the deviation in the direction perpendicular to the feeding direction.

In addition, in the above described embodiment, the time of start and the time of the end of erasure of a region (in the paper feeding direction) specified by coordinate data A and B are controlled by the timers determining the time of illumination of the LED elements. However, the present invention is not limited to the above described method. For example, the time for turning on and off of the clutch of the timing roller 73 may be controlled by timers.

Although a case of changing magnification is not indicated in the above described embodiment, known means for changing magnification may be used in combination.

Further, the erasure array 4 may be provided in such a position that it performs erasure operation after exposure of an image and before development. In addition, an eraser for edit copy may be provided independently of the erasure array.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus capable of copying a desired region of a document, comprising:

a rotating photoconductor, means for charging said photoconductor in advance, means for projecting an image of the document of said charged photoconductor to form an electrostatic latent image on said photoconductor, means for developing said electrostatic latent image, light emitting means for exposing to light, said photoconductor where said electrostatic latent image is to be formed, prior to the development of said electrostatic latent image, thereby to remove any unnecessary portion of said electrostatic latent image corresponding to a region other than said desired region of the document, said light emitting means having a predetermined perimeter of light emission on said photoconductor, means for inputting data for specifying said desired region of the document to be copied, and control means for controlling a period of time for emission of light of said light emitting means based on data on said predetermined perimeter of emission of light of said light emitting means and the input data for specifying said desired region.

2. A copying apparatus in accordance with claim 1, wherein said light emitting means has an array of a plurality of light emitting elements.

3. A copying apparatus in accordance with claim 2, wherein said control means includes means for selecting light emitting elements to be turned on in said plurality of light emitting elements of said light emitting means, based on the input data for specifying said desired region.

4. A copying apparatus for forming an electrostatic latent image by projecting an image of a document onto a photoconductor, thereby to transfer said electrostatic latent image on a sheet of copy paper by developing said electrostatic latent image by toner, said copying apparatus comprising:

means for inputting data for specifying a region of the document to be copied, erasing means for erasing said electrostatic latent image formed on said photoconductor by exposing said photoconductor to light prior to the development of said electrostatic latent image, said erasing means having an array of a plurality of light emitting elements, each of said plurality of light emitting elements having a predetermined area of irradiation, and means for controlling the selection of those light emitting elements to be turned on in said plurality of light emitting elements of said erasing means and a period of time for turning on said light emitting elements, based on the input data for specifying the region to be copied and data on said predetermined area of irradiation of each of said light emitting elements.

5. A copying apparatus capable of copying a desired region of a document, comprising:

a movable photoconductor;

means for charging said photoconductor in advance;

means for projecting an image of the document on said charged photoconductor to form an electrostatic latent image on said photoconductor;

means for developing said electrostatic latent image;

light emitting means for exposing to light said photoconductor where said electrostatic latent image is to be formed, prior to the development of said electrostatic latent image, thereby to remove any unnecessary portion out of said electrostatic latent image, corresponding to a region other than said desired region of the document, said light emitting means having a prescribed extent for emission of light;

means for inputting data for specifying said desired region of the document to be copied;

means for selecting one of a first mode and a second mode;

first control means, operable in said first mode, for energizing said light emitting means concurrently with an initiation of the electrostatic latent image formation and for deenergizing said light emitting means when a portion of said photoconductor corresponding to a leading end of said desired region of the document reaches a first position which is a prescribed distance prior to a second position opposite to said light emitting means, said prescribed distance corresponding to the emission extent of said light emitting means, and second control means, operable in said second mode, for energizing said light emitting means when the portion of said photoconductor corresponding to a leading end of said desired region of the document reaches a third position which is said prescribed distance posterior to said second position.

6. In a copying apparatus capable of copying a desired indicia from a document to the exclusion of undesired indicia on the document by the selective activation of an array of light emitting diodes, the improvement comprising:

means for inputting data for specifying the desired indicia region of the document, and means for controlling the time period that those light emitting diodes corresponding to the desired indicia are activated, including means for storing data representative of the position and extent of effective light transmission of the light emitting diodes off of its optical axis and means for calculating from both the inputted data and the stored data the actual time period.

* * * * *